US007343772B2

(12) United States Patent
Shuckhart

(10) Patent No.: US 7,343,772 B2
(45) Date of Patent: Mar. 18, 2008

(54) DEVICE FOR APPLYING OUTER SKIN TO AN AUTOMOTIVE DOOR FRAME

(76) Inventor: Michael A. Shuckhart, 1739 Hill St., White Oak, PA (US) 15131

( * ) Notice: Subject to any disclaimer, the term of this patent is extended or adjusted under 35 U.S.C. 154(b) by 0 days.

(21) Appl. No.: 11/357,611

(22) Filed: Feb. 17, 2006

(65) Prior Publication Data

US 2007/0193332 A1 Aug. 23, 2007

(51) Int. Cl.
*B21J 13/02* (2006.01)
*B21D 5/16* (2006.01)

(52) U.S. Cl. ..... 72/479; 72/413; 72/456; 72/457; 72/458; 72/176; 29/34 R; 29/275; 29/243.57; 29/243.58

(58) Field of Classification Search ..... 72/176, 72/456, 457, 458, 413, 479; 29/34 R, 275, 29/243.57, 243.58
See application file for complete search history.

(56) References Cited

U.S. PATENT DOCUMENTS 2,810,420 A * 10/1957 Gibson ..... 72/479
3,477,272 A * 11/1969 Hunter ..... 29/243.58
3,541,836 A * 11/1970 Meis ..... 72/479
3,602,032 A * 8/1971 Skintzis ..... 29/243.58
3,777,687 A * 12/1973 Colman, Jr. ..... 29/243.58
4,034,595 A * 7/1977 Smith ..... 72/458
4,060,046 A * 11/1977 Eckold et al. ..... 29/243.58
5,394,729 A * 3/1995 Eisenhower, Jr. ..... 72/450
6,439,024 B1 * 8/2002 Staquet ..... 72/458
6,578,404 B1 * 6/2003 Rousseau ..... 29/243.58
6,609,406 B1 * 8/2003 Staquet ..... 72/479
7,107,660 B2 * 9/2006 Staquet ..... 72/479
2002/0121125 A1 * 9/2002 Palleschi et al. ..... 72/479

* cited by examiner

*Primary Examiner*—David B Jones
(74) *Attorney, Agent, or Firm*—James Ray & Assoc.

(57) ABSTRACT

A device for applying an outer skin to an automotive frame. The device comprises at least one member formed from a preselected material and having a predetermined shape and a substantially U-shaped notch formed closely adjacent a first end of the at least one member. There is a tapered portion disposed on one predetermined face of the substantially U-shaped notch for engaging an outer portion of such outer skin and forcing such outer portion to turn down and engage such automotive door frame.

20 Claims, 2 Drawing Sheets

DEVICE FOR APPLYING OUTER SKIN TO AN AUTOMOTIVE DOOR FRAME

FIELD OF THE INVENTION

The present invention relates, in general, to a device used in automotive repair, and, more specifically the present invention relates to a device for applying outer skin to an automotive door frame.

BACKGROUND OF THE INVENTION

In automotive repairs, particularly in the repair of body parts after an accident, there are many parts that are relatively inaccessible and provide a challenge to mechanic or repair person. After an accident in which there is damage to the body of the vehicle many of the repairs involve covering undamaged body parts with new "skin". This reduces the cost to both the insurance companies and to the person paying for the insurance since undamaged parts need not be replaced.

One example of such an accident would be a fender bender or an accident where the door panel is pushed in but the door frame is untouched. In such cases the framework would remain and the door skin would be replaced or similarly with other type accidents.

One problem that the repair person has in this type repair is mounting the skin on the frame without damaging the new skin in mounting it, say, on the door frame. Sometimes this becomes difficult because some of the parts are relatively difficult to reach or are difficult to put a tool in the part requiring attachment. It would be desirable if there were a tool which could aid in such repair to facilitate the repair and also minimize the possibility of damaging the new skin on the door frame.

SUMMARY OF THE INVENTION

In a first aspect the present invention provides a device for applying an outer skin to an automotive frame. The device comprises at least one member formed from a preselected material and having a predetermined shape and a substantially U-shaped notch formed closely adjacent a first end of the at least one member. There is a tapered portion disposed on one predetermined face of the substantially U-shaped notch for engaging an outer portion of such outer skin and forcing such outer portion to turn down and engage such automotive door frame.

In a second aspect the present invention provides a device for applying an outer skin to an automotive frame. The device comprises a housing member having a first predetermined shape and made of a first predetermined material. There is a first member fixedly secured to the housing member, the first member having a second predetermined shape and formed of a second predetermined material and a second member slidingly securable with the first member by means of a bolt and enclosed in the housing member, such second member having a third predetermined shape and formed of a third predetermined material. There is a substantially U-shaped notch, a portion of the U-shaped notch formed in the first member and a second portion of the U-shaped notch formed in the second member and a tapered portion disposed on a face of the portion of the U-shaped notch formed in such second member for engaging an outer portion of such outer skin and forcing such outer portion to turn down and engage such automotive frame. There is a biasing means disposed in a slot formed in the second member, the biasing means is caged between an upper end of the slot and with such bolt for securing the second member with the first member for biasing second member to a first position and a securing means for fixedly securing such first member to the housing member.

OBJECTS OF THE INVENTION

It is, therefore, one of the primary objects of the present invention to provide a device for applying an outer skin to an automotive door frame.

Another object of the present invention is to provide a device that fits in the groove of a door frame so as to be able to turn the outer skin down.

Still another object of the present invention is to provide a device for applying an outer skin to an automotive door frame that is simple to use.

Yet another object of the present invention is to provide a device for applying an outer skin to an automotive door frame that is relatively inexpensive to manufacture.

These and various other objects and advantages of this invention will become apparent after a full reading of the following detailed description, particularly, when read in conjunction with the attached drawings as described below and the appended claims.

Figure 1:
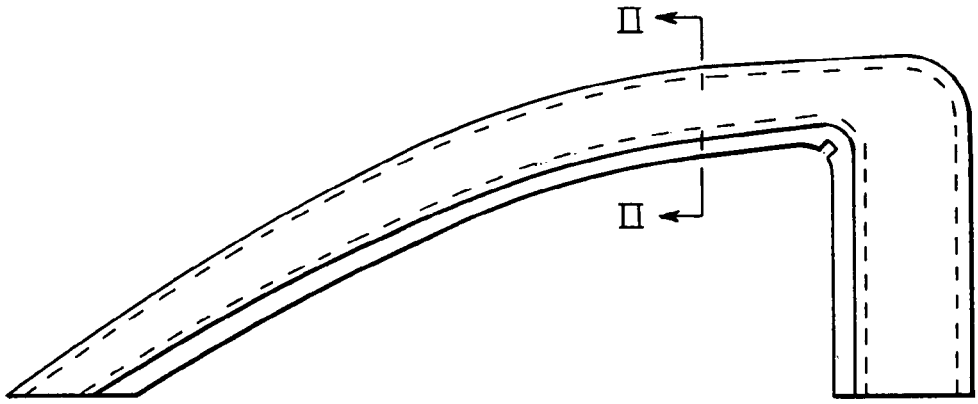
FIG. 1 PRIOR ART
FIG. 1 is a side view of an automotive door frame with an outer skin attached thereto.
Figure 2:
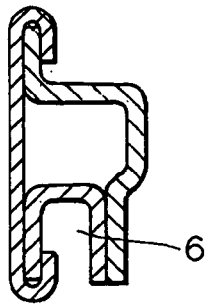
FIG. 2 PRIOR ART
FIG. 2 is a cross sectional view taken across the lines of II-II of the automotive door frame shown in FIG. 1.
Figure 3:
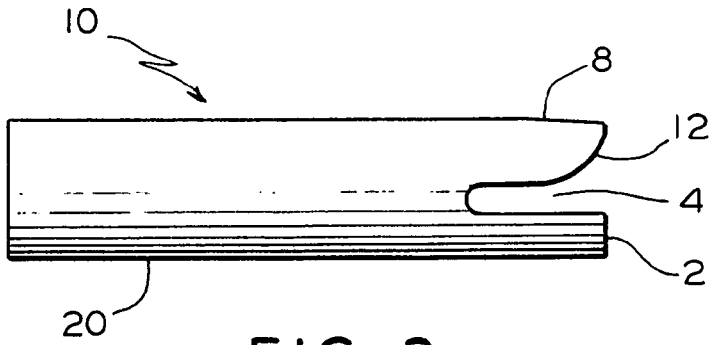
FIG. 3 is a side view of a device for attaching an outer skin to an automotive door frame according to an embodiment of the invention.
Figure 4:
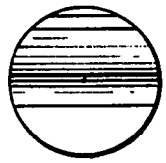
FIG. 4 is an end view of the device shown in FIG. 3 for attaching an outer skin to an automotive door frame.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

There has been a problem with mounting new "skin" on a door frame because of the narrow area that a worker has to attach the skin. Such skin has to be turned under in a groove that runs the length of the door frame. The area is too narrow to be able to use most tools and, further, one must be extremely careful that the new skin, which is usually pre painted is not damaged or that paint finish not marred.

The present invention provides a device, generally designated 10, in which one portion 2 of a U-shaped notch 4 fits into a groove 6 in an automotive door frame while an adjacent part 8 engages the outer portion of the door skin. As the end opposite the U-shaped notch 4 is hammered the adjacent portion 8 which has a tapered area 12 engages the skin and forces it down into the door frame groove 6. The device 10 is moved down the door frame and the process repeated until the skin is forced into place all along the door frame.

In a first aspect the present invention provides a device 10 for applying an outer skin to an automotive frame. The device 10 comprises at least one member 20 formed from a preselected material and having a predetermined shape and a substantially U-shaped notch 4 formed closely adjacent a first end of the at least one member 20. There is a tapered portion 12 disposed on one predetermined face 8 of the substantially U-shaped notch 4 for engaging an outer portion of such outer skin and forcing such outer portion to turn down and engage such automotive door frame.

It is presently preferred that such predetermined shape of the at least one member is substantially cylindrical; however, it is within the scope of the invention that such device could be hexagonal, octagonal or other various shapes. It is also presently preferred that such substantially U-shaped notch is formed in the first end of the at least one member.

Again it must be mentioned that force must be applied to a second end of the at least one member to force the tapered portion to engage an outer portion of such outer skin and thereby force such outer portion to turn down and engage such automotive frame. The force is generally applied by the use of a hammer.

The inner surfaces of the substantially U-shaped notch are very smooth so as to not mar the finish on such skin as such skin is forced into a groove in such automotive frame. This is important because the skin is usually already painted with a final coat of paint and care must be taken to not mar this finish.

It is also presently preferred that such preselected material for forming the device is a plastic material. Such plastic material could be selected from a variety of plastics; however, it is important that the plastic material is substantially rigid so that it can be hammered without distorting. Also in this embodiment it is preferred that such at least one member is only one.

Figure 5:
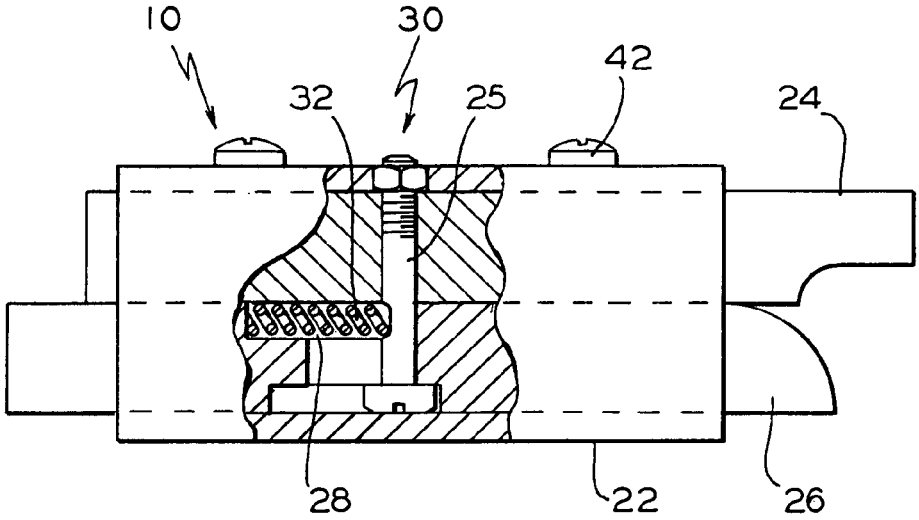
FIG. 5 is a side view of a device for attaching an outer skin to an automotive door frame according to an alternate embodiment of the invention showing the biasing means with the movable portion in an open position.
Figure 6:
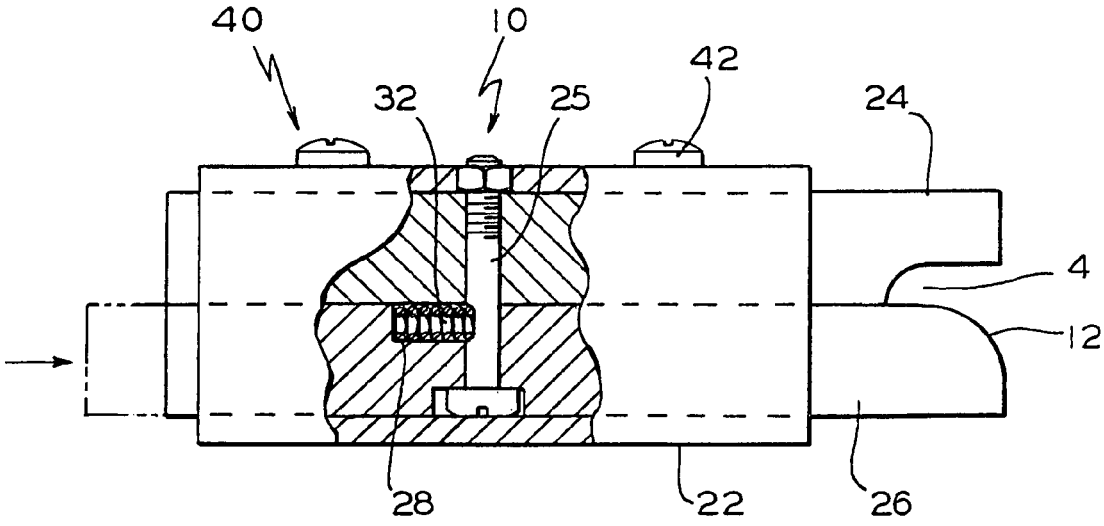
FIG. 6 is a side view of a device shown in FIG. 5 for attaching an outer skin to an automotive door frame with the movable portion in a closed position.

In a second aspect of the present invention, as seen in FIGS. 5 and 6, there is provided a device 10 for applying an outer skin to an automotive frame. The device comprises a housing member 22 having a first predetermined shape and made of a first predetermined material. There is a first member 24 fixedly secured to the housing member 22, the first member 24 having a second predetermined shape and formed of a second predetermined material and a second member 26 slidingly securable with the first member 24 by means of a bolt 25 and enclosed in the housing member 22, such second member 26 having a third predetermined shape and formed of a third predetermined material. There is a substantially U-shaped notch 4, a portion of the U-shaped notch 4 formed in the first member 24 and a second portion of the U-shaped notch 4 formed in the second member 26 and a tapered portion 12 disposed on a face of the portion of the U-shaped notch 4 formed in such second member 26 for engaging an outer portion of such outer skin and forcing such outer portion to turn down and engage such automotive frame. There is a biasing means, generally designated 30, a biasing means disposed in a slot 28 formed in the second member 26, the biasing means 30 is caged between an upper end of the slot 28 and with the bolt 25 used for securing the second member 26 with the first member 24 such biasing means for biasing the second member 26 to a first position. There is also a securing means, generally designated 40, for fixedly securing such first member 24 to the housing member 22. Such securing means is one of screws 42 and bolts 42. It is presently preferred that such first predetermined shape of the housing member 22 is substantially cylindrical and is in a form of a sheath and that such second predetermined shape of first member 24 and such third predetermined shape of such second member 26 are substantially in the shape of a half moon.

The substantially U-shaped notch 4 is formed when said second member 26 is forced to a second position. When such second member 26 is in a first position the U-shaped notch 4 is not evident, it is only when force is applied to overcome the bias that the notch 4 is evident. Such second member 26 must be forced to such second position to overcome the bias thereby permitting the tapered portion 12 of the second member 26 to engage such outer portion of such outer skin and thereby forcing such outer portion to turn down and engage such automotive frame.

It is also presently preferred that such second and said third predetermined material are formed from similar material and that such similar material is plastic and, further, that such plastic is rigid.

Such securing means for securing such first member 24 to such housing member 22 is one of screws and bolts. Such biasing means 30 is a spring 32.

Figure 7:
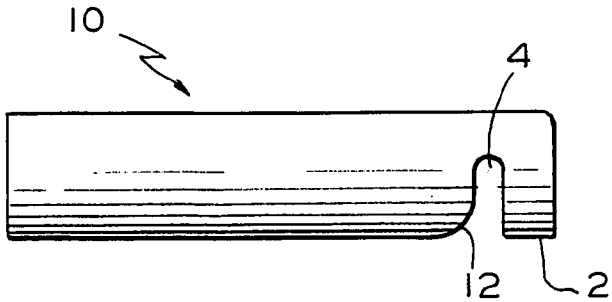
FIG. 7 is a side view of a device for attaching an outer skin to an automotive door frame according to yet another embodiment of the invention.
Figure 8:
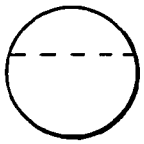
FIG. 8 is an end view of the device shown in FIG. 7 for attaching an outer skin to an automotive door frame.

FIGS. 7 and 8 show yet another alternate embodiment of the first aspect of the invention. In this embodiment the U-shaped notch 4 is not disposed on the end of the device 10 but is formed on the side of the device 10 closely adjacent to the end. In this case the worker would hammer on the top portion of the device 10 opposite the U-shaped notch 4 while portion 2 of the U-shaped notch 4 fits into groove 6 and the tapered portion 12 engages the skin and forces it down into the groove 6.

While a presently preferred embodiment and alternate embodiments of the present invention has been described in detail above, it should be understood that various other adaptations and/or modifications of the invention can be made by those persons who are particularly skilled in the art without departing from either the spirit of the invention or the scope of the appended claims.

I claim:

1. A device for applying an outer skin to an automotive frame, said device comprising:

(a) at least one member formed from a preselected material and having a predetermined shape;

(b) a substantially U-shaped notch formed closely adjacent a first end of said at least one member;

(c) a tapered portion disposed on only one predetermined face of said substantially U-shaped notch for engaging an outer portion of such outer skin and forcing such outer portion to turn down and engage such automotive frame.

2. The device, according to claim 1, wherein said predetermined shape of said at least one member is substantially cylindrical.

3. The device, according to claim 1, wherein said substantially U-shaped notch is formed in said first end of said at least one member.

4. The device, according to claim 1, wherein a force must be applied to a second end of said at least one member to force said tapered portion to engage an outer portion of such outer skin and thereby force such outer portion to turn down and engage such automotive frame.

5. The device, according to claim 1, wherein said substantially U-shaped notch is formed in a side of said at least one member closely adjacent said first end.

6. The device, according to claim 1, wherein inner surfaces of said substantially U-shaped notch are very smooth so as to inhibit marring a finish on such skin as such skin is forced into a groove in such automotive frame.

7. The device, according to claim 1, wherein said preselected material is a plastic material.

8. The device, according to claim 7, wherein said plastic material is substantially rigid.

9. The device, according to claim 1, wherein said at least one member is a single solid member.

10. A device for applying an outer skin to an automotive frame, said device comprising:

(a) a housing member having a first predetermined shape and made of a first predetermined material;

(b) a first member fixedly secured to a portion of an inner surface of said housing member, said first member having a second predetermined shape and formed of a second predetermined material;

(c) a second member slidingly securable with said first member by means of a bolt and enclosed in another portion of said housing member, said second member having a third predetermined shape arid formed of a third predetermined material;

(d) a substantially U-shaped notch, a portion of said U-shaped notch formed in said first member and a second portion of said U-shaped notch formed by said second member;

(e) a tapered portion disposed on a face of said second member for engaging an outer portion of such outer skin and forcing such outer portion to turn down and engage such automotive frame;

(f) a biasing means disposed in a slot formed in said second member, said biasing means caged between an upper end of said slot and with said bolt securing said second member with said first member for biasing said second member to a first position; and (g) a securing means for fixedly securing said first member to said housing member.

11. The device, according to claim 10, wherein said first predetermined shape of said housing member is substantially cylindrical and in a form of a sheath.

12. The device, according to claim 10, wherein second predetermined shape of said first member is substantially a half moon.

13. The device, according to claim 10, wherein third predetermined shape of said second member is substantially a half moon.

14. The device, according to claim 10, wherein said substantially U-shaped notch is formed when said second member is forced to a second position.

15. The device, according to claim 14 wherein said second member must be forced to said second position to overcome said bias thereby permitting said tapered portion of said second member to engage such outer portion of such outer skin and thereby forcing such outer portion to turn down and engage such automotive frame.

16. The device, according to claim 10, wherein said securing means is one of screws and bolts.

17. The device, according to claim 10, wherein said second and said third predetermined material are similar material.

18. The device, according to claim 17, wherein said similar material is plastic.

19. The device, according to claim 18, wherein said plastic is substantially rigid.

20. The device, according to claim 10, wherein said biasing means is a spring.

* * * * *